US006314583B1

(12) United States Patent
Cho

(10) Patent No.: US 6,314,583 B1
(45) Date of Patent: Nov. 13, 2001

(54) SPORTS CAP HAVING POCKET ON VISOR

(75) Inventor: Byung-Woo Cho, Seoul (KR)

(73) Assignee: Yupoong & Co., Ltd., Seoul (KR)

( * ) Notice: Subject to any disclaimer, the term of this patent is extended or adjusted under 35 U.S.C. 154(b) by 0 days.

(21) Appl. No.: 09/784,894

(22) Filed: Feb. 15, 2001

(30) Foreign Application Priority Data

Dec. 30, 2000 (KR) ..... 2000-37295

(51) Int. Cl.[7] ..... A41D 13/00
(52) U.S. Cl. ..... 2/195.1; 2/209.12
(58) Field of Search ..... 2/195.1, 175.1, 2/209.12, 209.13, 195.7, 175.6

(56) References Cited

U.S. PATENT DOCUMENTS 140,614 * 7/1873 Cassiano ..... 2/175.6
437,607 * 10/1890 Wustemann ..... 2/175.6
5,003,639 * 4/1991 White ..... 2/187
5,907,871 * 6/1999 Austin ..... 2/209.12
6,012,176 * 1/2000 Daley, III ..... 2/209.13
6,185,748 * 2/2001 DeChambeau ..... 2/195.1

* cited by examiner

*Primary Examiner*—Bibhu Mohanty
(74) *Attorney, Agent, or Firm*—Armstrong, Westerman, Hattori, McLeland & Naughton, LLP

(57) ABSTRACT

A sports cap, having a stretchable pocket on the entire top surface of the visor and preferably worn on the head of a user while exercising, golfing, climbing or fishing, is disclosed. This sports cap has a visor integrated along the lower front edge of a crown into a single body through a sewing process, which a pocket provided on the entire top surface of the visor by sewing a stretchable pocket fabric along the rounded front edge of the visor. An opening is formed on the pocket at a position along the rear edge of the stretchable pocket fabric, with an elastic tape liner integrated along the rear edge of the pocket fabric and sewn to the visor at opposite ends thereof together with the pocket fabric so as to elastically tighten the opening of the pocket. The sports cap allows a user to easily and conveniently store a variety of personal necessities, such as golf tees, ball markers, a cigarette pack, a lighter, a match box, scratch papers, name cards, receipts, or score sheets, in the pocket.

1 Claim, 2 Drawing Sheets

SPORTS CAP HAVING POCKET ON VISOR

BACKGROUND OF THE INVENTION

1. Field of the Invention

The present invention relates, in general, to a sports cap consisting of a crown integrated with both a sweat band and a visor into a single body and preferably worn on the head of a user while exercising, golfing, climbing or fishing and, more particularly, to a sports cap having a stretchable pocket on the entire top surface of the visor and allowing a user to easily and conveniently store a variety of small-sized personal necessities, such as golf tees, ball markers, a cigarette pack, a lighter, a match box, scratch papers, name cards, receipts, or score sheets, in the pocket.

2. Description of the Prior Art

While golfing, most golfers typically keep their personal necessities, such as golf tees, ball markers, cigarette packs, lighters, match boxes, scratch papers, name cards, receipts, or score sheets, in the pockets of their golfing trousers.

On the other hand, several types of sports caps, having small pockets at desired external or internal positions of the crowns, have been proposed and used. Such small pockets of sports caps may be provided with flaps or fasteners.

However, the pockets of conventional sports trousers undesirably disturb an action of a user, for example, a tee-shot driving action while golfing, thus being sometimes inconvenient for the user.

The sports caps having small pockets on desired external positions of the crowns have the following problems. That is, when a user wants to keep a golf tee in the external pocket of his cap while golfing, it is necessary for the user to take off the cap so as to keep the tee in the pocket without failure. In addition, since a user must bring several tees while golfing, the user has to feel for tees in the external pocket individually when it is desired to use a specific tee kept in the pocket. This forces the user to frequently take off his cap while golfing, The conventional external pockets of the sports caps have fixed sizes and fixed shapes, and so it is impossible to store an item having a size or shape disagreeing with the pocket. The conventional external pockets of a sports cap also have to be sewn to the crown one by one, and so the pocket complicate the production process of the sports caps and increase the manufacturing cost of the caps.

Additionally, the sports caps having small pockets on desired internal positions of the crowns are problematic in that they force users to frequently take off the caps and open the flaps or fasteners of the internal pockets when it is desired to put items in the internal pockets. Another problem, experienced in the conventional internal pockets of sports caps, resides in that the items kept in the pockets undesirably put pressure on the head of users wearing the caps, thus making the users' heads to feel uncomfortable. In addition, the items in the internal pockets of sports caps move around in the pockets during active movements of the users, thus putting further pressure on the users' heads and disturbing the users while playing or moving outdoors.

SUMMARY OF THE INVENTION

Accordingly, the present invention has been made keeping in mind the above problems occurring in the prior art, and an object of the present invention is to provide a sports cap, which has a stretchable pocket on the entire top surface of the visor and allows a user to easily and conveniently store a variety of small-sized personal necessities on the pocket.

In order to accomplish the above object, the present invention provides a sports cap, comprising a visor integrated along the lower front edge of a crown into a single body through a sewing process, further comprising: a pocket provided on the entire top surface of the visor by sewing a stretchable pocket fabric along the rounded front edge of the visor, with an opening formed on the pocket at a position along the rear edge of the stretchable pocket fabric, and an elastic tape liner integrated along the rear edge of the pocket fabric and sewn to the visor at opposite ends thereof together with the pocket fabric so as to elastically tighten the opening of the pocket.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
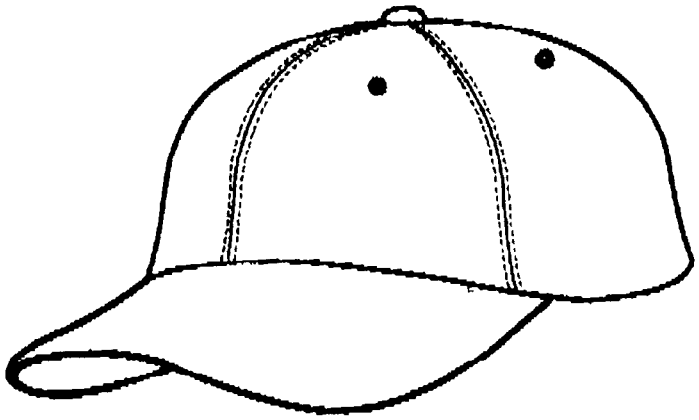
FIG. 1 is a perspective view of a conventional sports cap, showing the appearance of the cap.
Figure 2:
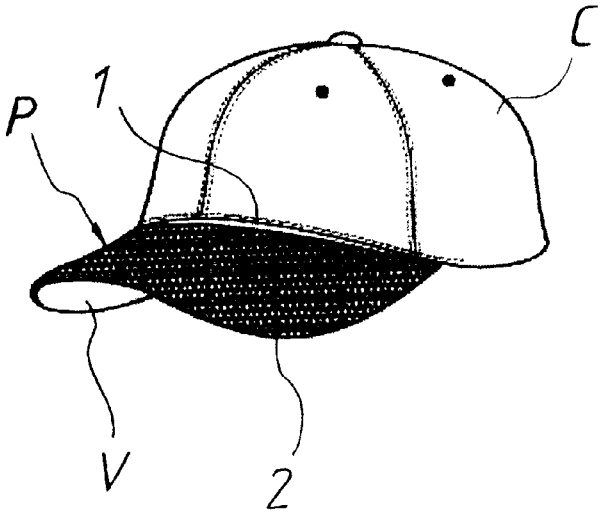
FIG. 2 is a perspective view of a sports cap having a pocket on the visor in accordance with the preferred embodiment of the present invention.
Figure 3:
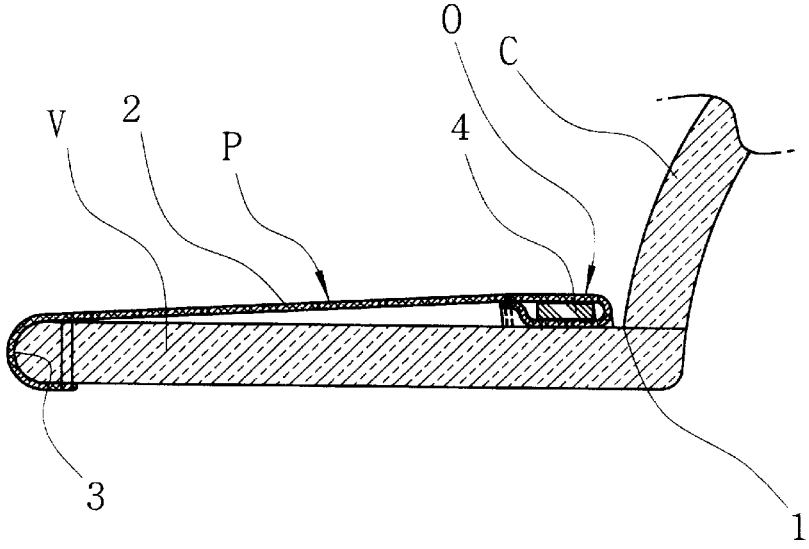
FIG. 3 is a sectional view of the visor of the sports cap according to this invention, particularly showing the construction of the pocket provided on the visor.
Figure 4:
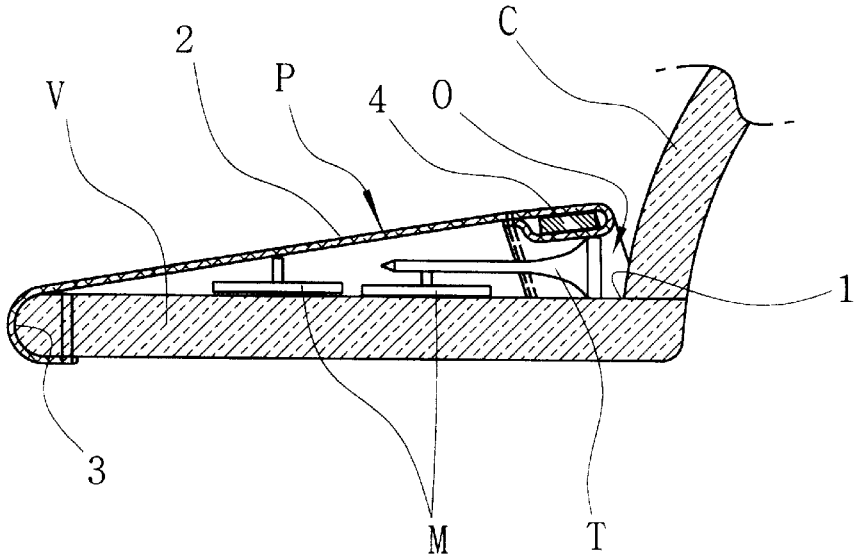
FIG. 4 is a sectional view of the visor of this sports cap, particularly showing the open position of the pocket provided on the visor.

FIG. 1 shows the appearance of a conventional sports cap, while FIGS. 2 to 4 show a sports cap having a pocket on the visor in accordance with the preferred embodiment of the present invention.

As shown in FIGS. 2 to 4, the sports cap of this invention comprises a visor "V" integrated along the lower front edge of a crown "C" into a single body through a sewing process. A sewing line 1 is formed along the junction of the crown "C" and the visor "V" of this cap in a conventional manner used in the sports cap of FIG. 1. The sports cap of this invention further comprises a pocket "P" provide along the entire top surface of the visor "V" by sewing the rounded front edge 3 of a stretchable pocket fabric 2 along the rounded front edge of the visor "V". In such a case, an opening "O" is formed on the pocket "P" at a position along the rear edge of the stretchable pocket fabric 2. An elastic tape liner 4 is integrated along the rear edge of the pocket fabric 2 and is sewn to the visor "V" at opposite ends thereof together with the pocket fabric 2, thus elastically tightening the opening "O" of the pocket "P".

In the sports cap of this invention, the elastic tape liner 4 is preferably made of an elastic tape, which has a width of about 0.5 mm and is reinforced with a latex yarn or a polyurethane yarn in an axial direction. On the other hand, the stretchable pocket fabric 2 is preferably selected from a net fabric, such as a Raschel warp knitted fabric or a mesh fabric. When such a net fabric is used as the pocket fabric 2 of this cap, it is possible for a user to easily observe the items, such as golf tees "T" or ball markers "M", kept in the pocket "P" from the outside, thus allowing the user to easily pick up a desired item from the pocket. In addition, the opening "O" of the pocket "P" of this cap is lined with the extendible tape liner 4, and so the pocket "P" is easily opened or closed as desired without using any separate fastener, such as a zip-fastener. Another advantage of the pocket "P" having such an opening "O" resides in that the appearance of the pocket "P" is improved over a conventional pocket having a separate fastener at the opening.

Different from a conventional sports cap having two or more small-sized pockets, the sports cap of this invention has one large-sized pocket on its visor. The pocket of this invention is thus conveniently usable for storing a variety of items without being limited by the shapes or sizes of the items if the items can be put into the pocket. In addition, the pocket "P" of this invention is provided on the top surface of the visor "V" integrated along the lower front edge of the crown "C", and so a user can easily and conveniently keep desired items in the pocket "P" and wear the sports cap without being disturbed or pressurized by the items in the pocket "P" while playing or moving. A user, wearing the sports cap of this invention, is also allowed to easily store or take out a desired item into or from the pocket using his fingers without taking off the cap from his head. In addition, a user of this sports cap is not disturbed or pressurized at his head by the items stored in the pocket "P" while playing or moving since the pocket "P" is positioned on the top surface of the visor "V" in place of the crown "C".

In the sports cap of this invention, it is preferable to design the pocket "P" to allow the edge of the opening "O" to be normally positioned along a line spaced apart from the sewing line 1 of the cap by a gap of about 0.5 mm. When the gap between the edge of the opening "O" and the sewing line 1 is smaller than 0.5 mm, it is somewhat difficult for a user to open the pocket "P" when necessary. On the other hand, when the gap is larger than 0.5 mm, the gap may spoil the appearance of the cap in the case of a normal position of the pocket "P".

As described above, the present invention provides a sports cap having a pocket on the visor. In the sports cap of this invention, the stretchable pocket is provided on the entire top surface of the visor and allows a user to easily and conveniently store a variety of personal necessities in the pocket. The pocket of this invention is conveniently usable for storing a variety of items without being limited by the shape or size of the items if the items can be put into the pocket. When the pocket is made of a stretchable fabric having a color different from that of the crown, it is possible to improve the design of the sports cap with a combination of colors.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A sports cap, comprising a visor integrated along a lower front edge of a crown into a single body through a sewing process, further comprising:

a pocket provided on an entire top surface of said visor by sewing a stretchable pocket fabric along a rounded front edge of said visor, with an opening formed on the pocket at a position along a rear edge of said stretchable pocket fabric, and an elastic tape liner integrated along the rear edge of the pocket fabric and sewn to the visor at opposite ends thereof together with the pocket fabric so as to elastically tighten said opening of the pocket.

* * * * *